United States Patent [19]

Chu et al.

[11] 4,378,418

[45] Mar. 29, 1983

[54] HOLE INJECTING CONTACT FOR OVERCOATED PHOTORECEPTORS

[75] Inventors: Joseph Y. C. Chu, Fairport, N.Y.; Keng-San Liang, Bridgewater, N.J.

[73] Assignee: Xerox Corporation, Stamford, Conn.

[21] Appl. No.: 78,995

[22] Filed: Sep. 26, 1979

Related U.S. Application Data

[63] Continuation of Ser. No. 71,894, Sep. 4, 1979, abandoned.

[51] Int. Cl.[3] ..... G03G 3/04

[52] U.S. Cl. ..... 430/59; 430/60; 430/64; 430/66

[58] Field of Search ..... 430/55, 57, 59, 58, 430/60, 64, 65, 66

[56] References Cited

U.S. PATENT DOCUMENTS

| | | | |
|---|---|---|---|
| 3,041,167 | 6/1962 | Blakney et al. | 430/125 |
| 3,730,709 | 5/1973 | Kinoshita et al. | 430/55 |
| 3,813,243 | 5/1974 | Kitajima et al. | 430/55 |
| 3,816,118 | 6/1974 | Byrne | 430/76 X |
| 3,926,762 | 12/1975 | Goldstein | 430/64 |
| 3,953,207 | 4/1976 | Horgan | 430/58 |
| 3,961,953 | 6/1976 | Millonzi et al. | 430/58 |
| 3,973,957 | 8/1976 | Rochlitz et al. | 430/58 |
| 3,982,937 | 9/1976 | Wiedemann | 430/58 |
| 4,047,948 | 9/1977 | Horgan | 430/59 |
| 4,071,363 | 1/1978 | Jones | 430/130 |
| 4,078,925 | 3/1978 | Horgan | 430/59 |
| 4,081,274 | 3/1978 | Horgan | 430/59 |
| 4,123,269 | 10/1978 | Von Hoene et al. | 430/67 X |

*Primary Examiner*—John E. Kittle
*Assistant Examiner*—John L. Goodrow
*Attorney, Agent, or Firm*—E. U. Palazzo

[57] ABSTRACT

Disclosed is a layered photosensitive device which can be used in an electrophotographic imaging system, this device comprising a substrate which can be conductive or nonconductive, a hole injecting layer capable of injecting positive charges or holes into a layer on its surface, comprised of trigonal selenium, alloys of selenium-tellurium or nickel selenide, a combined or separate transport and generating layer in operative contact with the layer of hole injecting material such layer in one embodiment being comprised of an inorganic or organic photoconductive materials, and as an optional layer an insulating resin overlaying the photoconductive layer. Examples of materials useful as the transport-generating layer include selenium, arsenic-selenium alloys, metal phthalocyanines, metal free phthalocyanines. Also certain types of diamine compounds can be used as the transport layer.

4 Claims, 5 Drawing Figures

HOLE INJECTING CONTACT FOR OVERCOATED PHOTORECEPTORS

This is a continuation of application Ser. No. 071,894, filed, Sept. 4, 1979, now abandoned.

BACKGROUND OF THE INVENTION

This invention is generally directed to electrophotographic imaging devices and more specifically to electrophotographic photosensitive devices which in one embodiment are comprised of a layered device containing a specific hole injecting layer and a top layer of an insulating material.

The electrophotographic process, and more specifically the xerographic process is well known. In one known method the latent image present on the photoconductive surface is developed by marking particles such as toner, followed by transfer and fusing of the image to a permanent substrate. Many types of different photoreceptors can be used in such methods including organic materials, inorganic materials and mixtures thereof. There are known photoreceptors wherein the charge carrier generation and charge carrier transport functions are discrete contiguous layers. Also known are photoconductors which include an overcoating layer of an electrically insulating polymeric material and in conjunction with this overcoated type photoreceptor there have been proposed a number of imaging methods.

In the imaging methods using photoreceptors with an overcoating layer as described for example in the text by R. M. Schaffert on Electrophotography published by Focal Press Ltd., London, 1975, it is necessary to store charge carriers at the interface between the photoconductor and the overcoat layer preceeding the imagewise exposure. This is accomplished in non-ambipolar photoconductors by the injection of charge carriers from the substrate electrode into the photoconductor. Thus, in order to obtain a high quality image, the electrode must satisfy the requirements that it injects charge carrier sufficiently and uniformly into the photoconductor. Additionally, the electrode should adhere well to the photoconductor surface and to the supporting base on its back.

SUMMARY OF THE INVENTION

It is therefore an object of this invention to provide an imaging member and an imaging method which satisfies the above-noted requirements.

It is yet another important object of the present invention to provide a hole injecting layer material for overcoated organic and inorganic photoreceptors which when utilized in an electrophotographic environment results in a device having excellent dark injection efficiency.

An additional object of this invention is to provide an electrophotographic device which allows chemical and mechanical protection for the electrically active components.

These and other objects of the present invention are accomplished by providing a novel layered photosensitive device which can be used in an electrophotographic copying system, which device comprises a substrate or supporting base, which can be conductive or non-conductive; a hole injecting layer comprised of trigonal selenium, alloys of selenium-tellurium or nickel selenide and, capable of injecting holes into a layer on its surface, a transport and generating layer in operative contact with the layer of hole injecting material, this layer preferably being comprised of organic or inorganic photoconductive materials and in a preferred embodiment a layer of an insulating organic resin overlying the photoconductor layer. The photoconductive layer can function both as a generator and transport layer, or a separate transport and generating layer can be provided. A photoreceptor device containing a hole injecting layer of nickel, and a nickel selenide interface overcoated with trigonal selenium has a high efficiency for injecting holes into the photoconductive layer.

This layered structure, and more specifically the hole injecting material having the desired electrical and mechanical properties can generally be formed by various different methods including a sequential vapor deposition under vacuum wherein a conductive metal layer such as nickel is deposited on a substrate. Generally the process for preparing the photoconductive layer of the present invention involves either vacuum deposition of an inorganic photoconductive material such as selenium, or selenium-tellurium alloys, or solvent coating of an organic material or organic photoconductive material such as a phthalocyanine material. Upon final curing of the composite, a strong bond is obtained between the hole injecting layer and the substrate and the hole injecting layer and the transport layer. The transport and/or generating layer can then be overcoated with a layer of an electrically insulating overcoating layer. Depending on the type of photoreceptor device desired, the process conditions can vary accordingly.

In one preferred embodiment of the present invention, the hole injecting layer is comprised of a trigonal selenium. This layer can be formed in one preferred embodiment by sequential vapor deposition in a vacuum coater of a metal and selenium onto a supporting substrate. A trigonal selenium layer is formed on top of the metal layer by thermal conversion from the vapor deposited selenium. The substrate can be either conductive such as aluminum or non-conductive such as Mylar. The process details depends on the type of photoreceptor device desired. The general process steps for preparing such a hole injecting layer include:

(A)

1. Heat substrate to 95° to 100° C. in a vacuum coater.
2. Vapor deposition sequentially of a metal layer of 500 to 2,500 Angstroms thick and a selenium layer of 1,000 to 10,000 Angstroms thick.
3. Lower the substrate temperature and continue to deposit a layer of inorganic photoconductive material such as selenium, When an organic photoconductor is used, the preferred process steps are as follows:

(B)

1. Deposit sequentially a metal layer of 500 to 2,500 Angstroms thick and a selenium layer of 1,000 to 10,000 Angstroms onto the desired substrate at room temperature in a vacuum coater.
2. Overcoat the structure with a layer of organic photoconductor by solution coating.
3. Dry the composite at elevated temperatures.

The sequential deposition process of metal and selenium prevents the formation of a metal oxide which is undesirable to the formation of continuous trigonal selenium layer at the metal-photoconductor interface. The trigonal selenium is prepared by heating either during selenium deposition (process A) or during drying of the organic photoconductor layer (process B). Metals such as nickel, aluminum, chromium, copper and the like can be used, with nickel being preferred. The preferred hole injecting layer comprises a layer of nickel, a layer of nickel selenide, and a top layer of trigonal selenium. Such as structure was shown to have excellent hole injecting efficiency.

In one preferred method of operation the above described device is charged a first time with electrostatic charges of negative charge polarity, subsequently charged a second time with electrostatic charges of a positive polarity for the purpose of substantially neutralizing the charges residing on the electrically insulating surface of the member, and subsequently exposing the member to an imagewise pattern of activating electromagnetic radiation thereby forming an electrostatic latent image. This image can then be developed to form a visible image which is transferred to a receiving member. The imagimg member may be subsequently re-used to form additional reproductions after the erase and cleaning steps are accomplished.

BRIEF DESCRIPTION OF THE DRAWINGS

For a better understanding of the present invention and further features thereof, reference is made to the following detailed description of various preferred embodiments wherein.

DESCRIPTION OF THE PREFERRED EMBODIMENTS

Figure 1:
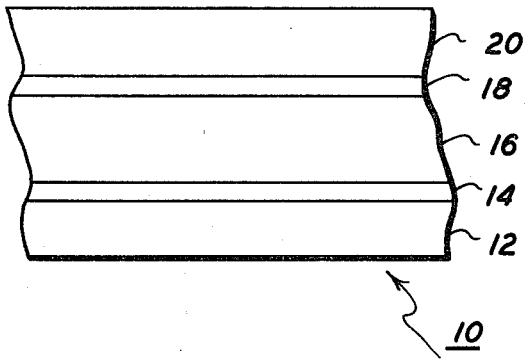
FIG. 1 is a partially schematic cross-sectional view of the photoreceptor device of the present invention.
Figure 1A:
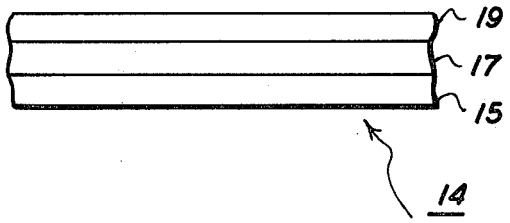
FIG. 1A is a cross-sectional view of one preferred hole injecting layer.

Illustrated in FIG. 1 is a photoreceptor generally designated 10 comprising as an optional layer a substrate 12, a layer of hole injecting material 14, a transport layer 16 and a generating layer 18 comprised of organic or inorganic photoconductive materials, and as an optional layer an overcoated layer 20 generally comprised of a layer of electrically insulating polymeric materials. Layer 14 in one embodiment, see FIG. 1A, can be comprised of conductive layer containing a bottom layer of nickel 15, an overlayer of trigonal selenium 19, and an interface of nickel selenide 17, between the nickel and trigonal selenium it being noted that the conductive layer can be part of the substrate layer itself. When the substrate is a polymeric material such as Mylar it is preferred to include thereover an adhesive material so as to substantially permanently bind the hole injecting layer to the substrate. Further the layers 16 and 18 can be a composite layer and thus function as a transport generating layer or individual layers can be present as shown, layer 16 functioning as the transport layer in such an embodiment.

Substrate 12 may comprise any suitable material having the requisite mechanical properties. Thus, for example, the substrate can be comprised of a layer of nonconducting materials such as inorganic or organic materials like glass, or Mylar, a commercially available polymeric material; a layer of an organic or inorganic material having a conductive surface thereon, or conductive materials such as aluminum, nickel or the like. One of the primary purposes of the substrate layer is for support, and systems can be envisioned where the substrate might be dispensed with entirely. The thickness of the optional substrate layer is dependent upon many factors including economical considerations; thus, this layer may be of substantial thickness for example over 100 mils or of minimum thickness, that is approximately 5 mils provided there are no adverse effects on the system. In one preferred embodiment the thickness of this layer ranges from 3 mils to about 10 mils. The substrate may be flexible or rigid, and may have many different configurations such as for example, a plate, a cylindrical drum, a scroll, an endless flexible belt, and the like.

The hole injecting layer 14 which in one embodiment is comprised of a conductive layer and an overcoated layer of trigonal selenium should be capable of injecting charge carriers or holes into layers 16 and 18 under the influence of an electrical field in a preferred embodiment of the present invention. The injected charge carriers should be of the same polarity as the mobile carriers being transported by layer 16. The injecting layer in this embodiment acts as a conductive layer as well as an injecting layer. Illustrative examples of the conductive layer include, but are not limited to nickel, nickel selenide and the like. The conductive layer in the embodiment being described contains a nickel layer which is overcoated with a nickel selenide interface which in turn is over-coated with the trigonal selenium material. In this embodiment it is the nickel selenide interface that allows the injecting of holes from the trigonal selenium into the transport and generating layers. The thickness of the conductive layer ranges from about 500 Angstroms to about 1 micro millimeter and preferably from 1,000 Angstroms to about 2.500 Angstroms while the thickness of the trigonal selenium layer ranges from about 1,000 Angstroms to about 10,000 Angstroms and preferably from about 2,500 Angstroms to about 5,000 Angstroms.

The hole injecting layer 14 has a thickness in the range of about 500 Angstroms to about 5 microns or more, with the preferred range being from about 1,000 Angstroms to about 10,000 Angstroms. The minimum thickness is generally determined by the mechanical properties desired. The charge carrier injecting materials and charge carrier transport materials require a particular work function relationship in order that the holes or electrons to be injected from the former into the latter can be effectively accomplished, and normally the hole injecting layer has a relatively high work function whereas electron injecting materials have a relatively low work function.

The transport layer 16 and the generating layer 18 can be comprised of numerous inorganic or organic photoconductive materials. Layers 16 and 18 which can be one combined layer, or separate layers, the important feature of said layer or layers being the capability of transporting charge carriers and generating charge carriers, which involve one embodiment, the injection of photoexcited charge carriers into, for example, the transport layer when it is present as a separate layer; are preferably comprised of inorganic photoconductive materials such as amorphous selenium, various selenium alloys including arsenic selenium, selenium-tellurium, arsenic-sulfur selenium, selenium doped with various halogen materials and other suitable panchromatic inorganic photogenerating substances. Preferred organic photoconductive materials include phthalocyanines, like metal free phthalocyanines such as the X-form of phthalocyanine, or metal path alocyanines including vanadyl phthalocyanine. The transport layer is typically 20 to 60 microns in thickness. The generating layer is typically from about 0.5 to about 10 microns or more in thickness. Generally it is desirable to provide this layer in a thickness which is sufficient to absorb at least 90% or more of the incident radiation which is directed upon it in the imagewise exposure step. The maximum thickness of these layers depend primarily on factors such as mechanical consideration, for example whether a flexible photoreceptor is desired or whether a more rigid drum type photoreceptor is desired. As a combined transport generating layer the thickness ranges from about 20 to about 70 microns.

Also as a separate transport layer in contact with the hole injecting layer there can be used materials of the formula:

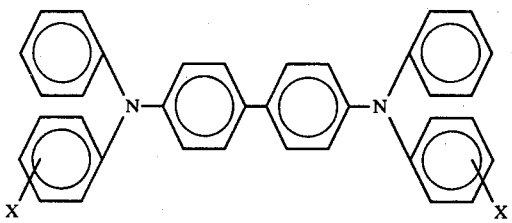

dispersed in a highly insulating and transparent organic resinous material wherein X is selected from the group consisting of (ortho)$CH_3$, (meta)$CH_3$, (para)$CH_3$, (ortho)Cl, (meta)Cl, (para)Cl. This charge transport layer, which is described in detail in U.S. Pat. No. 4,265,990, and totally incorporated herein by reference, is substantially non-absorbing in the spectral region of intended use, i.e., visible light, but is "active" in that it allows injection of photogenerated holes from the charge generator layer and electrically induced holes from the injecting interface. The highly insulating resin, which has a resistivity of at least $10^{12}$ ohm-cm to prevent undue dark decay, is a material which is not necessarily capable of supporting the injection of holes from the injecting or generator layer and is not capable of allowing the transport of these holes through the material. However, the resin becomes electrically active when it contains from about 10 to 75 weight percent of the substituted N,N,N',N'tetraphenyl-[1,1'-biphenyl]4-4'-diamines corresponding to the foregoing formula. Compounds corresponding to this formula include, for example N,N'-diphenylN,N-bis(alkylphenyl)-[1,1-biphenyl]-4,4'-diamine wherein the alkyl is selected from the group consisting of methyl such as 2-methyl, 3-methyl and 4-methyl, ethyl, propyl, butyl, hexyl and the like. In the case of chloro substitution, the compound is named, N,N'-diphenyl-N,N'-bis(halo phenyl)-[1,1'-biphenyl]4,4'-diamine wherein the halo atom is 2-chloro, 3-chloro or 4-chloro.

Other electrically active small molecules which can be dispersed in the electrically inactive resin to form a layer which will transport holes include triphenylmethane, bis-(4-diethylamino-2-methylphenyl)phenylmethane; 4',4''-bis(diethylamino)-2',2''-dimethyltriphenyl methane; bis-(4-diethylamino phenyl)phenylmethane; and 4,4'-bis(diethylamino)-2,2'-dimethyltriphenylmethane.

Transport layer 16 may also comprise any transparent electrically inactive binder resinous material such as those described by Middleton, et al, in U.S. Pat. No. 3,121,006, incorporated herein by reference. The resinous binder contains from 10 to 75 weight percent of the active material corresponding to the foregoing formula and preferably from about 40 to about 50 weight percent of this material. Typical organic resinous materials useful as the binder include polycarbonates, acrylate polymers, vinyl polymers, cellulose polymers, polyesters, polysiloxanes, polyamides, polyurethanes and epoxies as well as block, random or alternating copolymers thereof. Preferred electrically inactive binder materials are polycarbonate resins have a molecular weight ($M_w$) of from about 20,000 to about 100,000 with a molecular weight in the range of from about 50,000 to about 100,000 being particularly preferred.

Electrically insulating overcoating layer 20 typically has a bulk resistivity of from about $10^{12}$ to about $5\times10^{14}$ ohm-cm and typically is from about 5 to about 25 microns in thickness. Generally, this layer provides a protective function in that the change carrier generating layer is kept from being contacted by toner and ozone which is generated during the imaging cycles. The overcoating layer also must prevent corona charges from penetrating through it into charge carrier generating layer 18 or from being injected into it by the latter. Preferably, therefore, layer 20 comprises materials having high bulk resistivites. Generally, the minimum thickness of the layer in any instance is determined by the functions the layer must provide whereas the maximum thickness is determined by mechanical considerations and the resolution capability desired for the photoreceptor. Typical suitable overcoating materials include Mylar (a polyethylene terephthalate film commercially available from E. I. duPont de Nemours), polyethylenes, polycarbonates, polystyrenes, polyesters, polyurethanes and the like. This layer also serves to protect the combined layer 16 and 18.

The formation of the insulating layer over the charge transport-charge generating layer or layers may be accomplished by solution coating. When this layer constitutes a preformed mechanically tough film it is typically desirable to provide sufficint adhesive materials in order to provide an integral structure which is desirable for use in repetitive imaging methods. The electrical properties of such adhesive inner layers should be similar to those of the overcoating. Mechanically the adhesive inner layer should provide an adhesive state that firmly binds the layers together without any air gaps or the like which could disturb image definition.

Figure 2A:
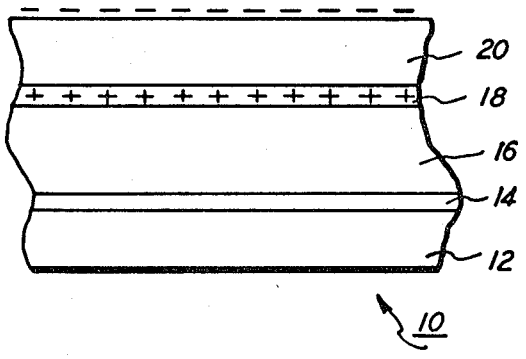
FIGS. 2A–2C illustrate the imaging steps employed.
Figure 2B:
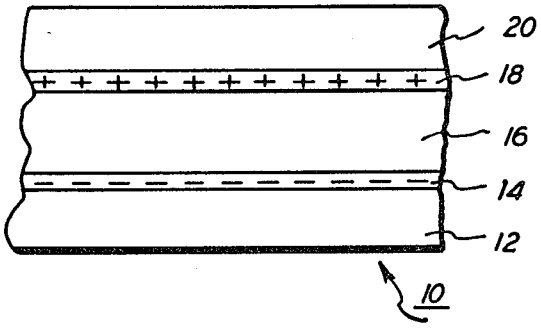
Figure 2C:
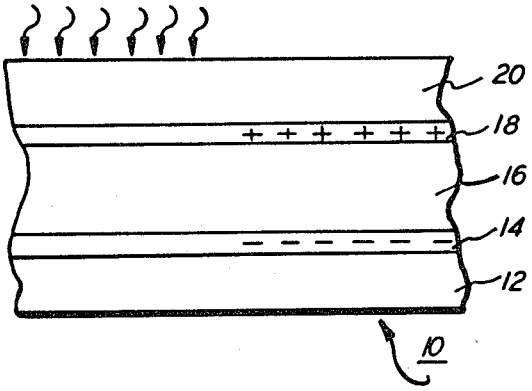

The operation of the member is illustrated with respect to FIGS. 2A–2C. In this illustrative explanation the initial charging step is carried out with negative polarity. As noted previously, the method is not limited to this embodiment. Moreover, the description of the method will be given in conjunction with the proposed theoretical mechanism by which the method is thought to be operative in order to better aid those skilled in the art to understand and practice the invention. It should be noted, however, that the method has been proved to be operable and highly effective through actual experimentation and any inaccuracy in the proposed theoretical mechanism of operation is not to be construed as being limiting of the invention.

Referring to FIG. 2A, there is seen the condition of the photoreceptor after it has been electrically charged negatively a first time in the absence of illumination by any suitable electrostatic charging apparatus such as a corotron. The negative charges reside on the surface of electrically insulating layer 20. As a consequence of the charging an electrical field is established across the photoreceptor and as a consequence of the electrical field, holes are injected from the charge carrier injecting layer into the charge carrier transport layer. The holes injected into the charge carrier transport layer are transported through the layer, enter into the charge carrier generating layer 18 and travel through the latter until they reach the interface between the charge carrier generating layer 18 and the electrically insulating layer where they become trapped. The charges thus trapped at the interface establish an electrical field across the electrically insulating layer 20. Thus, it is seen that in the embodiment where negative charging is carried out in the first charging step, charge carrier injecting layer 14 and charge carrier transport layer 16 must comprise materials which will allow injection of holes from the former into the latter and charge transport layer 16 preferably comprises material which will predominantly transport holes. Also, it can be seen that the charge carrier transport layer 16 and the charge carrier generating layer 18 must comprise materials which will allow injection of holes from the former into the latter and allow the holes to reach the interface between layer 18 and electrically insulating layer 20. Generally, the charging step is carried out with a voltage in the range of from about 10 volts/micron to about 100 volts/micron.

Subsequently, the member is charged a second time, again in the absence of illumination, with a polarity opposite to that used in the first charging step in order to substantially neutralize the charges residing on the surface of the member. In this illustrative instance, the second charging of the member is with positive polarity. After the second charging step the surface of the photoreceptor should be substantially free of electrical charges. The substantially neutralized surface is created by selecting a charging voltage based on the dielectric thickness ratio of the overcoating layer 20 to the total of the charge carrier transport and charge carrier generating layers, 16 and 18 respectively. By "substantially neutralized" within the context of this invention is meant that the voltage across the photoreceptor member, upon illumination of the photoreceptor, may be brought to substantially zero.

FIG. 2B illustrates the condition of the photoreceptor after the second charging step. In this illustration no charges are shown on the surface of the member. The positive charges residing at the interface of layers 18 and 20 as a result of the first charging step remain trapped at the interface at the end of the second charging step. However, there is now a uniform layer of negative charges located at the interface between layers 14 and 16.

Therefore the net result of the second charging step is to establish a uniform electrical field across the charge carrier transport and charge carrier generating layers. To achieve this result it is critical that the negative charges be located at the interface between charge carrier injecting layer 14 and charge carrier transport layer 16 and prevented from entering into the transport layer. For this reason it is preferred to utilize a charge carrier transport material which will transport only one species of charge carrier, holes in this illustrative instance. Where a charge carrier transport material capable of transporting both species of charge carriers is employed in layer 16, it is apparent that the charge carrier injecting material would have to be selected so that the injection material would be unable to inject electrons in layer 16 thus placing constraints on the selection of materials.

Subsequently in FIG. 2C, the member is exposed to an imagewise pattern of electromagnetic radiation to which the charge carrier generating material comprising layer 18 is responsive. The exposure of the member may be effected through the electrically insulating overcoating. As a result of the imagewise exposure an electrostatic latent image is formed in the photoreceptor. This is because hole electron pairs are generated in the light-struck areas into the charge carrier transport layer and travel through it to be neutralized by the negative charges located at the interface between layers 14 and 16 wherein the light-generated electrons neutralize the positive charges trapped at the interface between layers 18 and 20. In the areas of the member which did not receive any illumination, the positive charges remain in their original position. Thus, there continues to be an electrical field across the charge carrier transport and charge carrier generating layers in areas which do not receive any illumination whereas the electrical field across the same layers in the areas which receive illumination is discharged to some low level (FIG. 2C).

The electrostatic latent image formed in the member may be developed to form a visible image by any of the well known xerographic development techniques, for example, cascade, magnetic brush, liquid development and the like. The visible image is typically transferred to a receiver member by any conventional transfer technique and affixed thereto. While it is preferable to develop the electrostatic latent image with marking material the image may be used in a host of other ways such as, for example, "reading" the latent image with an electrostatic scanning system.

When the photoreceptor is to be reused to make additional reproductions as is the case in a recyclible xerographic apparatus, any residual charge remaining on the photoreceptor after the visible image has been transferred to a receiver member typically is removed therefrom prior to each repetition of the cycle as is any residual toner material remaining after the transfer step. Generally, the residual charge can be removed from the photoreceptor by ionizing the air above the electrically insulating overcoating of the photoreceptor while the photoconductive carrier generating layer is uniformly illuminated and grounded. For example, charge removal can be effected by A.C. corona discharge in the presence of illumination from a light source or preferably a grounded conductive brush could be brought into contact with the surface of the photoreceptor in the presence of such illumination. This latter mode also will remove any residual toner particles remaining on the surface of the photoreceptor.

The invention will now be described in detail with respect to specific preferred embodiments thereof, it being understood that these Examples are intended to be illustrative only and the invention is not intended to be limited to the materials, conditions, process parameters, etc., recited herein. All parts and percentages are by weight unless otherwise indicated.

EXAMPLE I

A trigonal selenium hole injecting electrode with a combined transport generating photoconductor layer coated thereover was prepared by sequential vapor deposition of nickel and selenium onto a Mylar substrate having a thickness of 7 mils in a standard vacuum coater with a background pressure of $10^5$ Torr, by first heating the Mylar substrate to 95° C. A layer of nickel of a thickness of 500 to 1,000 Angstroms was then vapor deposited using a resistance heated Tungsten boat. After nickel deposition, a layer of selenium of a thickness of 2,500 Angstroms was vapor deposited sequentially without breaking the vacuum from a stainless steel boat. The substrate temperature was then lowered to 55° C. A second layer of selenium of a thickness of 54 microns was subsequently vapor deposited. The device obtained was tested for charge acceptance. The device was charged with a plastinium corotron at positive or negative 4,500 volts and the measured surface potential was 75 volts when the device is charged negatively and 860 volts when charged positively. This indicates that the device has excellent hole injecting efficiency, since if holes not injected there would have been obtained a surface potential of about 860 volts when the device was charged netatively. The negative charge acceptance remains the same after repeated charging (80 cycles) of the device, indicating excellent cycling stability.

In another embodiment of this example there was used as the transport layer selenium, and coated thereover a generating layer of an arsenic selenium alloy, in place of the combined transport generating layer. The selenium layer in a thickness of 30 microns was vapor deposited on the hole injecting layer, followed by the vapor deposition of the arsenic selenium alloy layer in a thickness of 1 micron, over the transport layer, these depositions occurring in a vacuum using resistance heated Tungsten and stainless steel boats. This device was tested for charge acceptance as detailed above, and substantially similar results were obtained, indicating that such a device had excellent hole injection efficiency.

EXAMPLE II

The procedure as described in Example I was repeated using an aluminium substrate, in place of the Mylar substrate. The device obtained had a negative charge acceptance of 150 volts and a positive charge acceptance of 900 volts, indicating it would be useful in an electrostatographic imaging device.

EXAMPLE III

The procedure as described in Example I was repeated with the exception that aluminum was used in place of nickel. The device obtained had a negative charge acceptance of 250 volts and a positive charge acceptance of 870 volts, somewhat less hole injecting efficiency in comparison with nickel, nevertheless indicating it would be useful in an electrostatographic imaging device.

EXAMPLE IV

The procedure as described in Example I was repeated with the exception that chromium was used in place of nickel. The device obtained had a negative charge acceptance of 120 volts and a positive charge acceptance of 890 volts, indicating it would be useful in an electrostatographic imaging device.

EXAMPLE V

A hole injecting electrode having a thickness of about 3,500 Angstroms was fabricated using the same coating procedure of Example I on a Mylar substrate. A layer of nickel of 1,000 Angstroms and a layer of selenium of 2,500 Angstroms were sequentially vapor coated onto the Mylar substrate at room temperature, resulting in a hole injecting electrode comprised of a nickel substrate, overcoated with a nickel selenide layer, which in turn is overcoated with a trigonal selenium layer.

EXAMPLE VI

The hold injecting electrode prepared in Example V was solution coated from a methylene chloride solution using a draw bar coating technique with an organic transport layer 30 microns in thickness in a 1:1 ratio N,N,N',N'-tetra phenyl[1,1'-biphenyl] 4-4'-diamine/polycarbonate commercially available as Makrolon from Mobay Chemical. The entire structure was vacuum dired in an oven by heating at 80° C. for 24 hours. The resulted structure was tested for hole injecting efficiency. A residual voltage of only 5 volts was observed when the device was charged with a negative 4,000 volts indicating excellent hole injecting efficiency. Cycling the device showed no residual increase.

There was then vacuum deposited over the transport layer an approximately 0.6 micron thick amorphous arsenic triselenide photogenerating layer and an approximately ½ mil thick Mylar overcoating layer was then laminated over the arsenic triselenide layer.

The photoreceptor was charged a first time with a potential of −500 volts and then charged a second time with a potential of +1,000 volts. The photoreceptor was then uniformly illuminated with white light. Electrical measurements show that the field across the photoreceptor was discharged to substantially zero potential thus indicating that the photoreceptor is suitable for use according to the method of the present invention.

EXAMPLE VII

The procedure as described in Examples V and VI was repeated using aluminum instead of nickel. The resulting device has a somewhat lower injecting efficiency with a negative residual potential of 15 volts observed.

EXAMPLE VIII

A photoreceptor was fabricated by coating an approximately 14 micrometer thick polyester (PE-100) film (commercially available from Goodyear Chemicals) on the generating layer of the device as described in Example VI.

The photoreceptor was charged initially with a potential of −550 volts and then charged a second time with a potential of +1,100 volts. The photoreceptor was discharged to zero potential with white light illumination thus indicating that the photoreceptor is suitable for imaging according to the method of the present invention.

EXAMPLE IX

A photoreceptor was fabricated by coating an approximately 10 micrometer thick PE-100 polyester film on the surface of the generating layer of the device as described in Example VI. The sample was vacuum dried to remove the coating solvent (methylene chloride).

The photoreceptor was charged initially with a potential of −400 volts and then charged a second time with a potential of +900 volts. The photoreceptor was then discharged to zero potential with white light illumination thus indicating that the photoreceptor is suitable for use according to the method of this invention.

EXAMPLE X

A 3 inch by 3 inch sample of the photoreceptor device as fabricated in Examples VI, VII, VIII and IX was used to produce a xerographic reproduction with a modified Xerox Model D processor using conventional imaging steps, charging, imagewise exposure, development, transfer and fusing. An excellent reproduction of high quality and good resolution was obtained.

EXAMPLE XI

A photoreceptor device was fabricated in accordance with Example VI by coating an approximately 15 micrometer thick PE-100 polyester film on the surface of a 50 micron amorphous selenium layer which was vacuum deposited on the surface of N,N,N',N'tetra phenyl-[1,1'-biphenyl] 4-4'diamine/polycarbonate, 1:1 ratio. The device was then vacuum dried for 24 hours to remove the coating solvent (methylene chloride). This photoreceptor device was charged initially with a potential of −600 volts and then charged a second time with a potential of +1,000 volts. Subsequently this device was discharged to zero potential with white light illumination thus indicating that the photoreceptor is suitable for use according to the method of this invention.

Xerographic reproductions were made using this device with a modified Xero Model D processor as accomplished in Example X. Good quality reproductions of high resolution were obtained.

EXAMPLE XII

A photoresponsive device was prepared in accordance with Example VI with the exception that there is used as the photogenerating layer vanadyl phthalocyanine. This photogenerating charge carrier layer was prepared by mixing 0.8 grams of vanadyl phthalocyanine and 1.6 grams of 49,000 polyester commercially available from E. I. duPont, in methylene chloride and ball milling for about 80 hours. An approximately 3 microns thick layer of this composition was then deposited over the transport layer by solvent coating using a draw bar coating technique. The device was then dried to remove any residual methylene chloride.

Optionally and in place of the Mylar overcoating an approximately 10 micron thick overcoated layer of PE-100 polyester resin, described in Example VIII, was deposited over the charge carrier layer generating layer by solvent coating from a methylene chloride solution using a draw bar coating technique, followed by drying to remove any residual methylene chloride.

The above device was charged a first time with a potential of −600 volts, then charged a second time with a potential of +1,300 volts, and subsequently illuminated by light. Electrical measurements showed that the field across the photoreceptor was discharged to substantially zero, thus indicating that the photoreceptor device is suitable for allowing the formation of images according to the method of the present invention.

Although the invention has been described with respect to certain preferred embodiments, it is not intended to be limited thereto. Rather, those skilled in the art will recognize that variations and modifications may be made therein which are within the spirit of the invention and the scope of the claims.

What is claimed is:

1. A layered photosensitive device which comprises (a) a substrate, (b) a layer of material capable of injecting holes into a layer on its surface, this layer being comprised of nickel, overcoated with nickel selenide, which in turn is overcoated with trigonal selenium, (c) a hole transport layer in operative contact with the hole injecting layer, this layer being comprised of a material of the formula

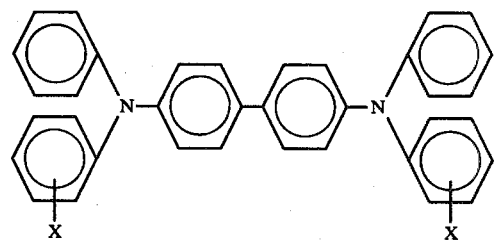

wherein X is selected from the group consistin of (ortho) $CH_3$, (meta) $CH_3$, (para) $CH_3$, (ortho) Cl, (meta) Cl, and (para) Cl;

(d) a charge generating material overcoated on the transport layer, this material being comprised of an inorganic or organic photoconductor material; and (e) a layer of insulating organic resin overlying the charge generating layer.

2. A layered photoresponsive device in accordance with claim 1 wherein the hole transport layer, and charge generating layer are combined into one layer.

3. A layered photoresponsive device in accordance with claim 1 wherein the photoconductor materials for the charge generating layer are selected from the group consisting of selenium, selenium arsenic alloys, halogen doped selenium arsenic alloys, metal phthalocyanines, metal free phthalocyanines, and vanadyl phthalocyanine.

4. A layered photoresponsive device in accordance with claim 1 wherein the electrically insulating organic resin is polyethylene terephthalate, a polycarbonate, or a polyester.

* * * * *